US007404362B2

(12) United States Patent
Webster et al.

(10) Patent No.: US 7,404,362 B2
(45) Date of Patent: Jul. 29, 2008

(54) MODEL TRAIN CAR WITH TILTING MECHANISM

(75) Inventors: Richard F. Webster, Carson, CA (US); Steven R. Greening, Grosse Pointe Woods, MI (US)

(73) Assignee: Lionel L.L.C., Chesterfield, MI (US)

( * ) Notice: Subject to any disclaimer, the term of this patent is extended or adjusted under 35 U.S.C. 154(b) by 380 days.

(21) Appl. No.: 11/139,310

(22) Filed: May 27, 2005

(65) Prior Publication Data

US 2006/0054052 A1 Mar. 16, 2006

Related U.S. Application Data

(60) Provisional application No. 60/575,264, filed on May 28, 2004.

(51) Int. Cl.
*B61D 17/00* (2006.01)

(52) U.S. Cl. ..... 105/1.5; 105/238.2

(58) Field of Classification Search ..... 104/287, 104/288, DIG. 1; 105/1.4, 1.5, 453, 238.2
See application file for complete search history.

(56) References Cited

U.S. PATENT DOCUMENTS

| | | | | |
|---|---|---|---|---|
| 5,980,358 | A * | 11/1999 | Diller, deceased | 446/467 |
| 6,186,074 | B1 * | 2/2001 | Grubba et al. | 105/1.5 |
| 6,190,279 | B1 * | 2/2001 | Squires | 475/149 |
| 2004/0103812 | A1 * | 6/2004 | Ruocchio et al. | 105/1.5 |

* cited by examiner

*Primary Examiner*—S. Joseph Morano
*Assistant Examiner*—Robert J McCarry, Jr.
(74) *Attorney, Agent, or Firm*—O'Melveny & Myers LLP

(57) ABSTRACT

A model vehicle, such as a model electric train, includes a motorized tilt mechanism for tilting train cars when traversing curved sections of track. The operation of the tilt mechanism is automated using a motor, drive train, and control circuit. A motorized tilt mechanism moves a train car body between left, right, and upright positions, depending on the direction and speed of movement of the model train. The control circuit permits automatic operation of the tilt mechanism in response to position and velocity input.

24 Claims, 7 Drawing Sheets

MODEL TRAIN CAR WITH TILTING MECHANISM

CROSS-REFERENCE TO RELATED APPLICATION

This application claims priority pursuant to 35 U.S.C. § 119(e) to U.S. Provisional Application No. 60/575,264, filed May 28, 2004, which application is specifically incorporated herein, in its entirety, by reference.

BACKGROUND OF THE INVENTION

1. Field of the Invention

The present invention relates to electric-powered model vehicles, such as model trains, and more particularly, to a tilting car for a model train or other model vehicle.

2. Description of Related Art

Various model trains and vehicles are known in the art, which model an actual or imaginary train or vehicle at a reduced scale. In a typical model layout, a model train having an engine is provided. The model train engine includes an electrical motor that receives power from a voltage that is applied to model railway tracks. A transformer is used to apply the power to the tracks, while contacts (e.g., a roller) on the bottom of the train, or metallic wheels of the train, pick up the applied power for the train motor. In some model train layouts, the transformer controls the amplitude, and in a DC system, the polarity, of the voltage, thereby controlling the speed and direction of the train. In HO systems, the voltage is a DC voltage. In O-gauge systems, the track voltage is an AC voltage transformed by the transformer from a household line voltage provided by a standard wall socket, such 120 or 240 V, to a reduced AC voltage, such as 0-18 volts AC.

Some model train cars include a tilting function, to provide greater stability when a train is traversing a curve, and to provide a more realistic simulation of an actual train. When actual passenger train cars traverse a curved portion of track at a high rate of speed, the resulting centrifugal forces may cause discomfort or safety risks for the occupants of the train car. Some passenger train cars are therefore equipped to tilt in the direction of the curve, so as to counteract these centrifugal forces. Model train cars may therefore also be designed for tilting, to achieve a higher degree of realism. In addition, a tilting mechanism may be useful to prevent model trains from derailing when traversing curves at high speed.

Notwithstanding these advantages, however, prior-art model trains with tilting mechanisms may be subject to certain limitations. For instance, conventional model trains achieve the tilting functionality using mechanical arrangements that lack optimal precision of control. The train car may not tilt to the desired degree at the desired time, which may result in derailment or decreased realism. For example, prior-art tilting mechanism will cause the same degree of tilting regardless of train velocity, which detracts from realism of the tilting effect. Furthermore, prior-art model trains with tilting mechanisms do not permit a user to tilt a train on command, and may require movement around a curved section of track to initiate tilting.

Accordingly, a need exists for a model train with a tilting mechanism that overcomes these and other limitations of the prior art.

SUMMARY OF THE INVENTION

The invention provides a model train car with an electronically controlled tilting mechanism configured to control tilting in any direction in response to velocity and track geometry, or in response to a user-issued command. A model vehicle in accordance with the present invention comprises a gear-driven pivoting coupling, which connects a model car body to wheel assemblies, also called "trucks," for the model car. The position of the pivoting coupling determines the tilt angle of the car body, and is in turn determined by a gear train driven by an electric motor. A tilt sensor is coupled to the car body and is connected to a tilt controller. The electric motor is driven by a control system that includes a programmable controller or control circuit that controls the electric motor, and hence, the tilt angle of the car, in response to input from the tilt sensor.

Further input to the control system may be provided by a position sensor disposed to sense the position of a coupling member, such as a drawbar for pulling the train car. When traversing a straight section of track, the drawbar is pulled substantially straight ahead. When traversing a curve, the drawbar is pulled either to the left or to the right, to an extent related to the radius of a curve. The position sensor is configured to provide a signal to the control system indicative of the position of the drawbar. The controller interprets the signal as indicating the direction and optionally, a degree of curvature of the track being traversed by the model car, and sends an appropriate control signal to the electric motor. The electric motor provides an appropriate output to the gear train, until the body of the car is tilting at an angle deemed appropriate for the curve being traversed.

In an embodiment of the invention, the angle of tilt may also be determined by the velocity of the car. It may be desirable to provide a greater degree of tilt when the car is moving quickly, and a lesser degree of tilt, or no tilt, when the car is more slowly. Accordingly, a velocity sensor may be connected to the tilt control system, and the controller may be configured to adjust the amount of tilt based on the velocity of the train in addition to the position of the coupling member.

In an embodiment of the invention, the title mechanism may also be controlled using user input, such as input from a remote control keypad or other user interface. For example, a user may select a range of operation for the tilt mechanism. In addition, or in the alternative, a user may control the tilt mechanism manually by sending commands via the user interface. Commands may be transmitted from a remote interface to the model train using any suitable wireless transmission method.

A more complete understanding of the model vehicle with a tilting mechanism will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides a model vehicle with an electronically controlled tilting mechanism, that overcomes the limitations of the prior art. In the detailed description that follows, like element numerals are used to indicate like elements appearing in one or more of the figures.

Figure 1:
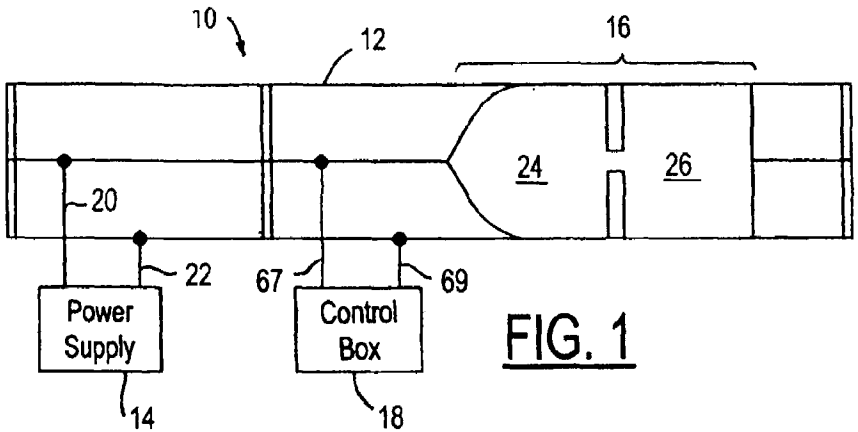
FIG. 1 is a plan view of a model vehicle layout in accordance with the present invention.

FIG. 1 shows a first exemplary embodiment of a model vehicle system 10. Model vehicle system 10 includes a track 12, a power supply 14, a train 16 and a control box 18. In an exemplary embodiment, track 12 may comprise a three rail track that is configured for travel thereon by train 16. Power source 14 provides power to track 12 by way of connectors 20 and 22, wherein the power terminal of the power supply is connected to the center or third rail of track 12, and the neutral terminal is connected to at least one of the two outer rails of track 12. Locomotive 24 of train 16 may be configured with contacts on the bottom thereof, or an arrangement of electrically conductive metallic wheels, to pick up the applied power and supply it to the electric motor of locomotive 24. In the alternative, or in addition, train cars other than locomotive 24 (i.e., train car 26) may be used to pick up the power from track 12.

Train car 26, comprising a tilt mechanism as described herein, may be connected to a controller or receiver in locomotive 24 via a wire or wireless connection. Elements of a control system for the tilt mechanism, or for train 16 generally, may be housed in a trackside control box 18. Control box 18 may transmit control signals via connectors 67, 68 through track 12 to train 16. Suitable transmission methods may include, for example DC-offset or RF signaling. The arrangement described above is for exemplary purposes only and is not meant to be limiting in nature.

With continued reference to FIG. 1, power source 14 may comprise a conventional AC or DC transformer, depending on the requirements of railroad layout 10, and in particular, train 16. Additionally, power source 14 may provide a fixed output, a variable output, or both. In an exemplary embodiment, railroad layout 10 is an 0-gauge layout and power source 14 is an AC transformer which transforms typical AC line voltage (e.g., 120 VAC) to a reduced level (e.g., 0-18 VAC for a conventional 0-gauge variable output model train transformer) and supplies the same to track 12.

Figure 2:
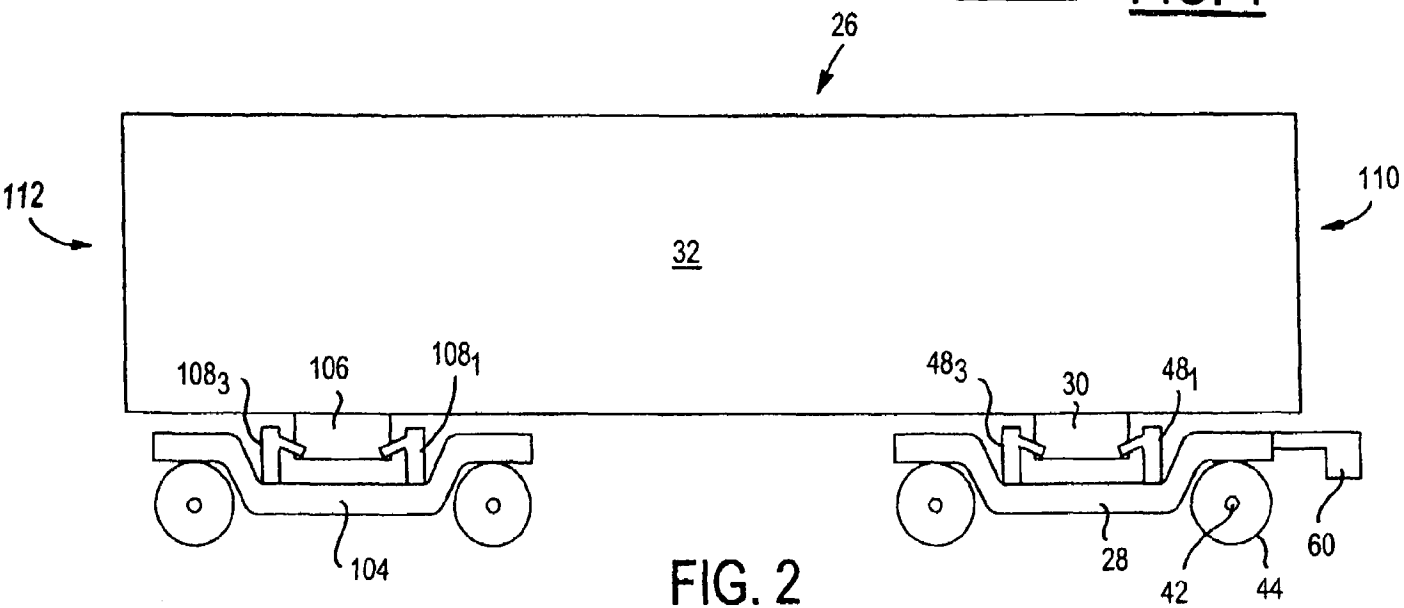
FIG. 2 is a side elevation view of a model vehicle with a tilting mechanism in accordance with the present invention.
Figure 3:
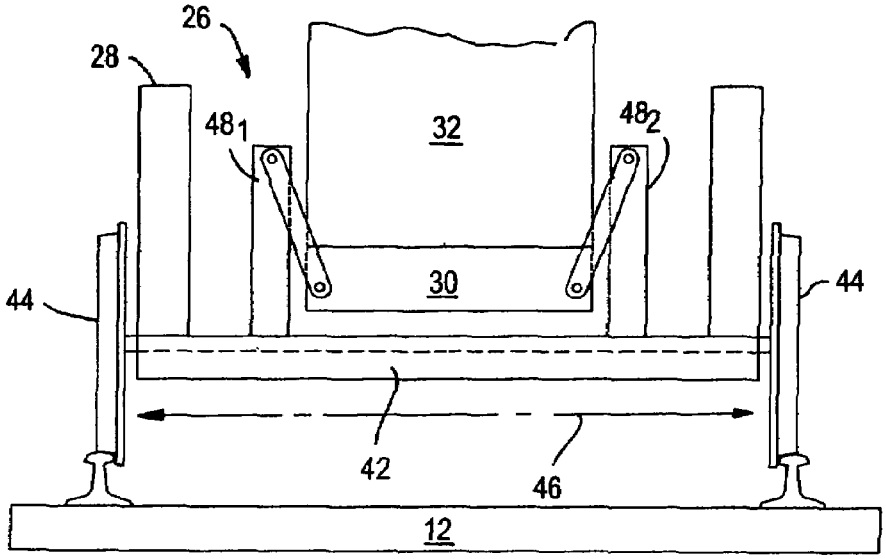
FIG. 3 is a partial front elevation view of a model vehicle with a tilting mechanism in accordance with the present invention.

FIGS. 2-3 are side and end views, respectively, showing an exemplary embodiment of an inventive train car 26 of train 16, such as a passenger car. Train car 26 may comprise a truck 28 with wheels 44 configured for model track 12, and a main train car body 32 pivotally coupled to truck 28 via support 30. Truck 28 comprises at least one axle 42 and wheel set 44, and is configured to ride on track 12 thereby defining a horizontal axis 46 extending through axle 42. Support 30 is pivotally coupled or pinned to truck 28, allowing support 30 to be suspended and pivot about a pivot point or points relative to truck 28.

Any suitable pivoting support may be used. For example, support 30 may be pivotally coupled to truck 28 using a single pivot point (not shown), or a plurality of pivot points. In the exemplary embodiment illustrated in FIGS. 2, 3 and 9A-C, support 30 is pivotally coupled to truck 28 at four pivot points: $\mathbf{48}_1$, $\mathbf{48}_2$, $\mathbf{48}_3$, and $\mathbf{48}_4$. Support 30 may be coupled to train car body 32 so that support 30 and body 32 can move together as support 30 pivots about pivot points $\mathbf{48}_1$, $\mathbf{48}_2$, $\mathbf{48}_3$, and $\mathbf{48}_4$, as will be discussed in greater detail below.

Train car 26 may comprise a second truck 104 and second support 106, in addition to the structure set forth above. In this embodiment, second support 106 is pivotally coupled or pinned to second truck 104 at one or several pivot points. In the illustrated embodiment, support 102 is coupled at four pivot points $\mathbf{108}_1$, $\mathbf{108}_2$, $\mathbf{108}_3$ and $\mathbf{108}_4$. Second truck 104 and second support 106 may be spaced a distance from truck 28 and support 30; and, as with support 30, train car body 32 is positioned on and supported by support 106. In the exemplary embodiment shown in FIG. 2, truck 28 and support 30 are pivotally positioned at a first end 110 of train car 26, while second truck 104 and corresponding second support 106 are pivotally positioned at a second end 112 of train car 26.

In the illustrated two-truck arrangement, train car body 32 is supported at one end by support 30 and at the other end by second support 106. Only one of the supports need be driven by a gear train providing a motor torque for tilting, while the other support may be passive. In the alternative, each support may be driven by a gear train receiving input from a motor. The same amount of torque and rotation may thereby be provided to both supports 30, 106, which therefore move in unison to tilt car 32. Other arrangements and spacing of the truck and supports that carry out the above functionality remain within the spirit and scope of the present invention. For example, more than two trucks or supports may be added for further support and precision. Exemplary gear trains for rotating the car supports are described below in connection with FIGS. 6-10. Movement of the supports may be controlled using a suitable control system.

Figure 4:
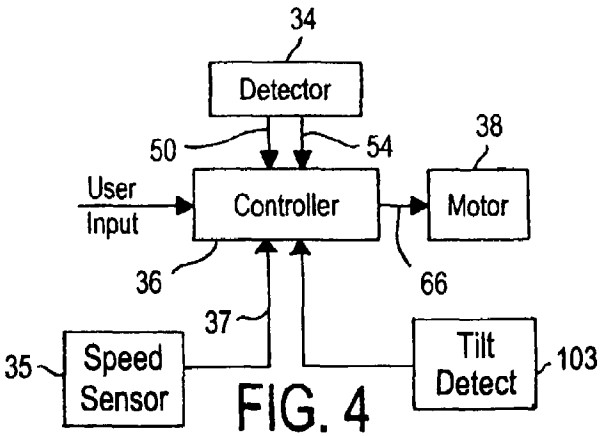
FIG. 4 is a schematic block diagram showing an exemplary control system for a tilting mechanism in accordance with the present invention.

FIG. 4 shows an exemplary control system for a tilt mechanism, comprising a controller 36 connected to a position sensor 34, a velocity sensor 35, a tilt sensor 103, a motor 38, and a gear set 40. Position sensor 34 may be provided to sense when train car 26 is traversing a curved section of track. For example, position sensor 34 may be configured to generate a first detection signal 50 indicative of truck 28 entering a curve in a first direction, and a second detection signal 54 indicative of truck 28 entering a curve in a second direction opposite to the first direction.

A velocity sensor 35 may also be connected to controller 36 and configured to sense the speed of train 16. In actual trains, the train car does not tilt until a defined speed (i.e., 25 miles per hour scaled speed, for example) is reached. Accordingly, in order to achieve optimum realism, velocity sensor 35 may be configured to sense the speed of train 16 and to generate a speed signal 37 in order determine when a predetermined scaled speed is reached. The use of velocity sensor 35 allows for the automatic tilting of train car body 32 only when a predetermined speed has been reached.

In an exemplary embodiment, velocity sensor 35 comprises a magnet and hall effect sensor positioned on truck 28 of train car 26. The magnet and hall effect sensor may be arranged such that as the magnet rotates with the wheel axle, the hall effect sensor generates signals corresponding to the frequency of rotation, thereby sensing the speed of the train.

In the alternative, velocity sensor 35 may comprise a conventional velocity sensor mounted proximate to the drive motor of train 16. In this configuration, velocity sensor 35 is arranged so as to read the speed of the drive motor output shaft, and then generate a speed signal 37 that is delivered to controller 36.

The system may further comprise a tilt sensor 103 operatively connected to controller 36. Tilt sensor may comprise any suitable sensor capable of providing a signal from which an amount of tilt of car body 32 may be determined. For example, an accelerometer or other gravimetric sensor may be used. In the alternative, the tilt of the car body may be determined from motion of the tilt mechanism, for example, by sensing a degree of rotation of the input motor shaft. According to yet another alternative, tilt sensor 103 may comprise a limit switch that provides a signal when tilting of the train car has reached predetermined limits. A signal from the tilt sensor may be provided to controller 36 as end-actuator feedback for controlling motor 38.

Position sensor 34, velocity sensor 35, and tilt sensor 103 may be operably connected to controller 36, whereby first and second curve position signals 50, 54 and speed signal 37 may be sent to or received by controller 36. Controller 36 is operable to receive input signals and to emit output signals, and may be operably associated with a memory within which data and program instructions may be stored. For example, controller 36 may comprise a microcontroller, a microprocessor, any suitable circuit comprising a programmable logic controller, or a circuit comprised entirely of analog devices. Controller 36 may also be configured to control other aspects of model train operation, including but not limited to operation of a main drive motor and various train accessories. In the alternative, controller 36 may be dedicated to operation of the tilt mechanism.

In response to position signals 50, 54 or speed signal 37 (e.g., when the speed of train 16 exceeds a predetermined threshold), controller 36 may be configured to generate a control output 66 for controlling motor 38. Various circuits and suitable control outputs for motor control are known in the art, and any suitable method of motor control may be used. For example, control output 66 may comprise a clockwise (CW) command signal and a counter clockwise (CCW) command signal for a motor controller. When control output 66 is provided to motor 38, an output shaft of motor 38 may rotate in either a clockwise or counter clockwise direction. In an exemplary embodiment, motor 38 may comprise a DC motor that is mounted to train car body 32 or to a frame of car 26. Controller 36 may also be configured to change the direction of rotation of motor 38, as will be discussed in detail below.

In addition to those features set forth above, controller 36 of train car 26 may also be configured to receive user input commands. Controller 36 may be further configured to generate the control output 66 in response to those user input commands, thereby causing body 32 of train car 26 to tilt whenever desired, regardless of whether the train is turning, traveling straight or standing still. For example, a user may command body 32 of train car 26 to tilt in either direction by way of remote control or by way of control box 18 (shown in FIG. 1) connected to track 12. It may also be desirable to temporarily disable or reactivate the tilting function based on user input. User signals may be generated in a number of ways, such as for example, a user selecting the desired functionality by way of a selection device located on control box 18, or a user sending the desired command by way of a remote control. Likewise, the input command can be received by controller in a number of ways. In one approach, control box 18 is connected to track 12 by way of connectors 67 and 69. Connector 67 connects control box 18 to the center rail of track 12, while connector 69 connects control box 18 to a neutral rail of track 12. Control box 18 receives a user command and then transmits the input signal to controller 36 by way of track 12.

Various methods may be used to communicate with the tilt controller. One method of transmitting the input signal is to use a DC protocol, comprising superimposing DC offsets on the AC voltage signal supplied to track 12 by power source 14. In this mode, when controller 36 detects a DC offset, it may generate a control output 66 to activate or deactivate the corresponding feature (i.e., to tilt train 16 in one direction or another). This conventional protocol comprises sending positive and negative DC offsets to controller 36. The different polarities and amplitudes of the DC offsets correspond to different features of train 12, and accordingly, are each operative to activate at least one of the features. In this approach, control block 18 includes a selection device, such as a pushbutton, that a user can use to select the desired feature and functionality.

Another suitable method may comprise using command control as known in the art for model trains. For example, U.S. Pat. Nos. 5,251,856, 5,441,223 and 5,749,547 to Young et al. disclose, among other things, providing a digital message, which may include a command, to train 16 using various techniques. The digital message(s) so produced may be read by controller 36, which may then execute the command by generating control output 66. This protocol allows a user to activate and deactivate features, such as for example, tilting train 16 in one direction or another, with control box 18 or by remote control. For example, using a suitably configured remote control device for a model train, a user may send a tilt command to control box 18, which then sends a corresponding digital message along track 12, which is then picked up by controller 36. A user may also select the desired action by way of a selection device on control box 18, which then transmits the digital input signal along track 12 to controller 36. It is foreseeable that a user may also send input signals by way of remote control to controller 36 itself, thereby bypassing control box 18 altogether. Those skilled in the art will appreciate that any other approach wherein a command can be generated, transmitted, and received may also be suitable for the above described purpose.

Figure 5:
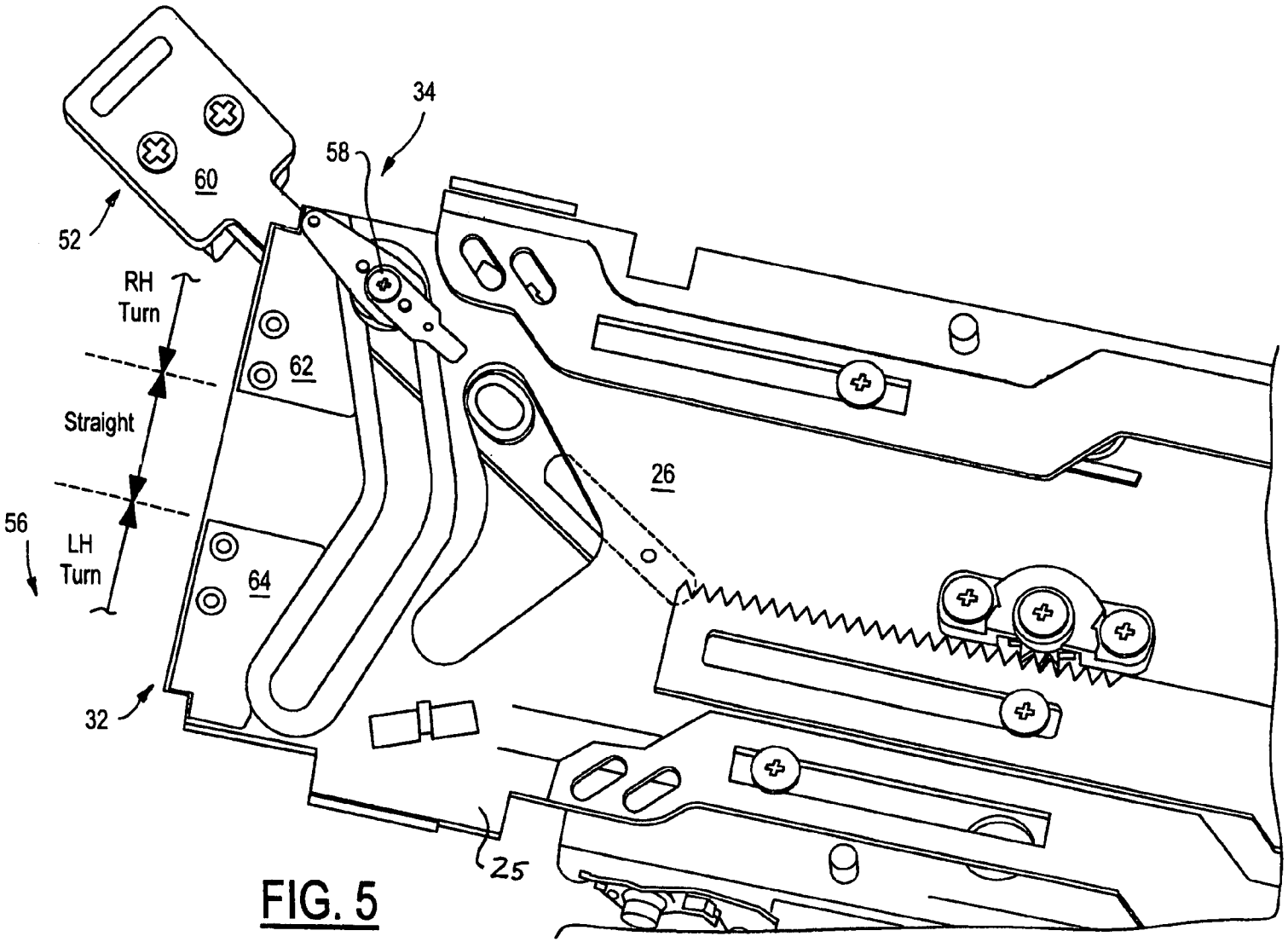
FIG. 5 is an plan view showing an exemplary position sensor for use in controlling a tilt mechanism.

FIG. 5 shows an exemplary embodiment for a position sensor used to determine when or to what extent a train car is traversing a curve. Position sensor 34 may comprise a first electrical contact 58 that is disposed on a coupling member 60, such as a drawbar associated with truck 28 of train car 26. Position sensor 34 may further comprise second and third electrical contacts 62, 64 disposed on a frame 25 for train car body 32. Second and third electrical contacts 62, 64 may be arranged to be spaced a predetermined distance apart and configured such that as train 16 enters into a turn in a first direction 52, coupling member 60 also moves in first direction 52 causing first electrical contact 58 to complete an electrical circuit with second electrical contact 62, providing a first position signal 50. Similarly, as train 16 enters into a turn in a second direction 56, coupling member 60 also moves in second direction 56 causing first electrical contact 58 to complete an electrical circuit with third electrical contact 64, providing a second position signal 54. Any desired number of contacts like 62, 64 may be provided on frame 25 to provide additional position information. For example, contacts may be positioned to provide a signal when coupling member 60 is in a straight-ahead position.

With reference to FIGS. 6-9C, a gear set 40 may be provided to translate rotation of the output shaft of motor 38 to support 30, and therefore, body 32, in response to control output 66. Support 30 may be mechanically coupled to and driven by gear set 40 and, as set forth above, may be pivotally coupled to truck 28. This arrangement permits movement of body 32 relative to horizontal axis 46 into the turn of truck 28 in first and second tilt directions about pivot points $\mathbf{48}_1$, $\mathbf{48}_2$, $\mathbf{48}_3$, and $\mathbf{48}_4$, mimicking the tilt of an actual train. For example, a desired tilt angle of body 32 may be about six degrees off center of a vertical axis 68 (best shown in FIGS. 9A-9C), wherein vertical axis 68 is perpendicular to horizontal axis 46 and extends through the center of truck 28 and support 30.

Figure 6:
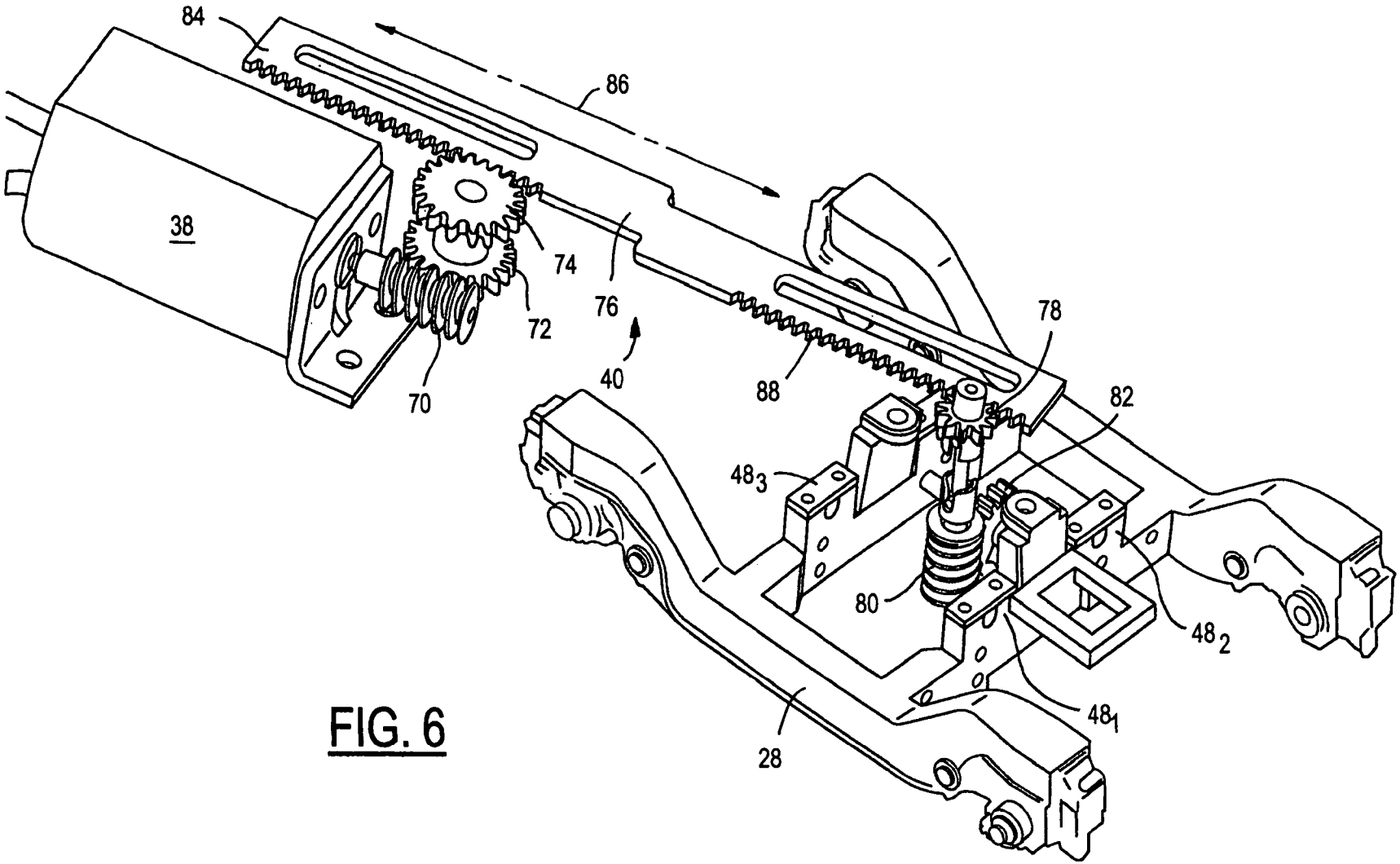
FIG. 6 is a perspective view showing an exemplary tilt mechanism in accordance with the present invention.
Figure 8:
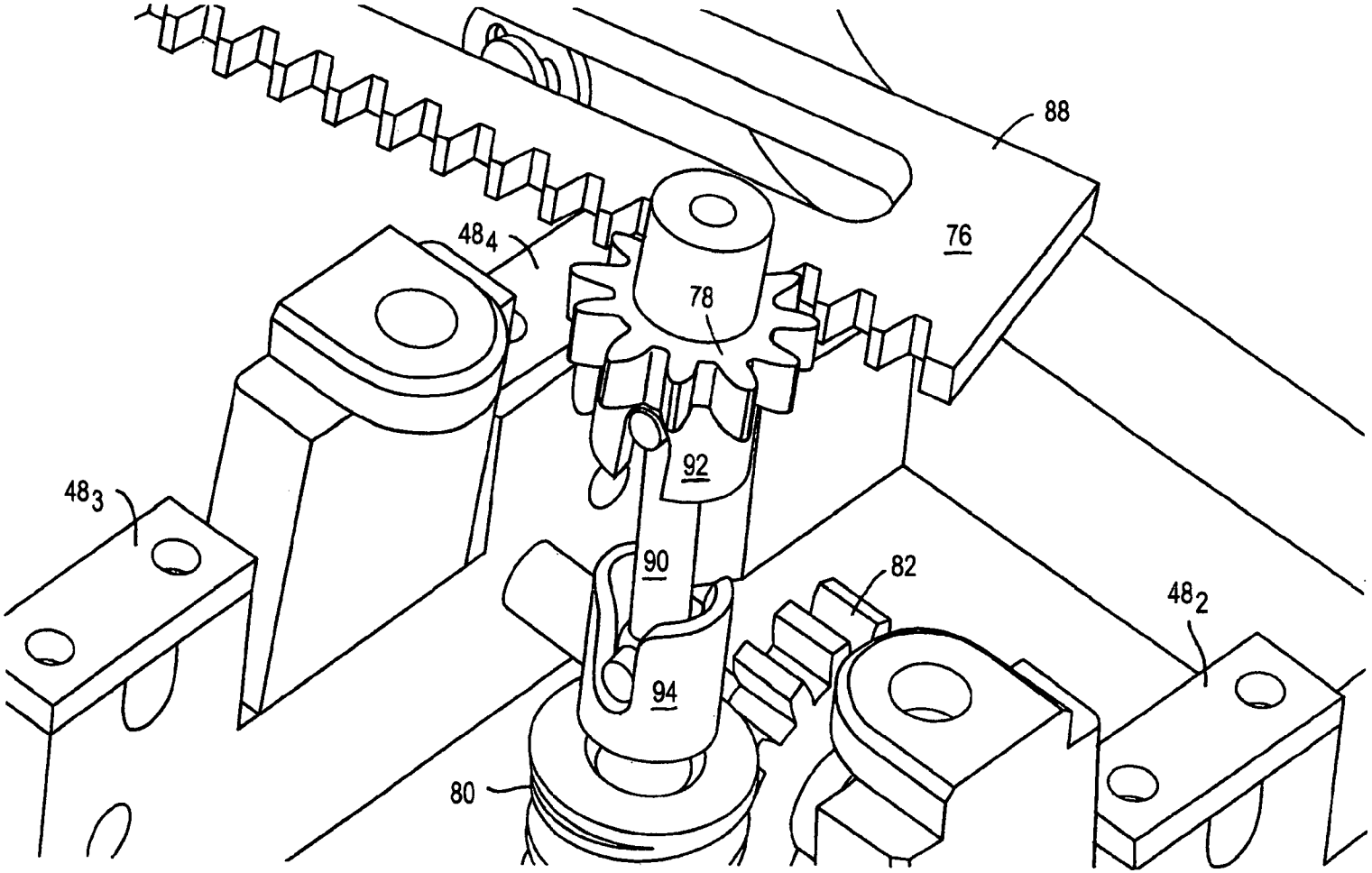
FIG. 8 is a perspective view showing a portion of an exemplary tilt mechanism in accordance with the present invention.

With reference to FIGS. 6 and 8, in an exemplary embodiment, gear set 40 may comprise a first worm gear 70 on an output of the motor 38. Worm gear 70 may mesh with first spur gear 72, which is connected to a second spur gear 74. Gear 74 drives rack gear 76, which drives a third spur gear 78. Gear 78 meshes with a second worm gear 80, which drives a slotted spur gear 82 connected to platform 30, best shown in FIG. 9A. First worm gear 70 is associated with and integral to the output shaft of motor 38, and accordingly, rotates in either a clockwise or counter clockwise direction in response to control signal 66. First spur gear 72 and second spur gear 74 may be formed together, such as by molding, as a single piece.

In the illustrated embodiment, first spur gear 72 is in mesh with and driven by first worm gear 70. First spur gear 72 is also coupled with second spur gear 74 by way of a axial shaft, such that the rotation of first spur gear 72 causes second spur gear 74 to rotate. Second spur gear 74 is in mesh with teeth disposed at a first end 84 of rack gear 76, and is configured to drive rack gear 76 in a first and second direction, depending on the direction of rotation of the output shaft, along a horizontal plane 86 defined by rack gear 76. Teeth disposed at a second end 88 of rack gear 76 are in mesh with third spur gear 78 disposed on horizontal plane 86, such that the movement of rack gear 76 is translated to third spur gear 78. Third spur gear 78 is further coupled to a rod 90 disposed perpendicular to horizontal plane 86 and within a pair of U-joints 92, 94, so that as third spur gear 78 rotates, rod 90 also rotates. Rod 90 is further coupled to and configured to drive second worm gear 80, which is positioned directly below third spur gear 78. Accordingly, as third spur gear 78 and rod 90 rotate, second worm gear 80 also rotates. The rotation of second worm gear 80 is then translated to a slotted spur gear 82 that is in mesh with and driven by second worm gear 80.

Figure 9A:
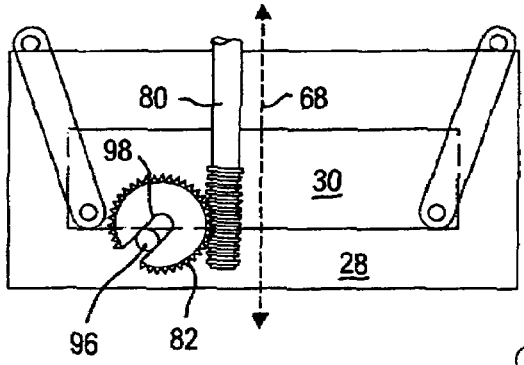
FIGS. 9A-C are schematic side views illustrating operation of a tilt mechanism in accordance with the present invention.
Figure 9B:
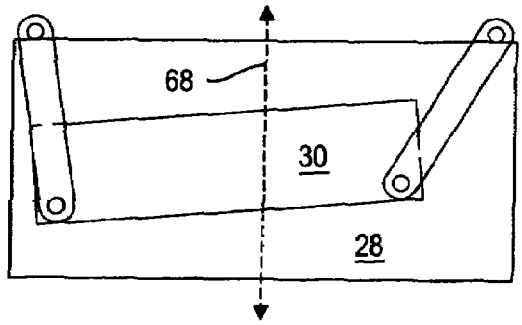
Figure 9C:
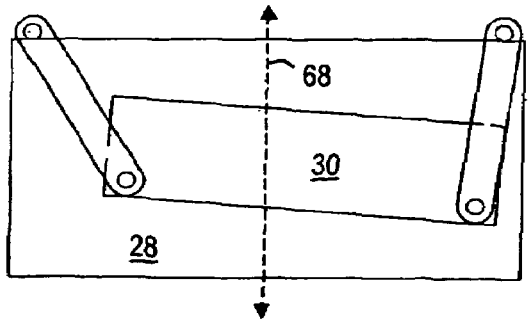

Exemplary operation of the pivoting support 30 is further illustrated by FIGS. 9A-9C. Slotted spur gear 82 may be coupled to support 30 by way of a pin 96 protruding from support 30 that is disposed within a slot 98 of spur gear 82 (best shown in FIG. 9A). Therefore, as slotted spur gear 82 rotates in either a clockwise or counter clockwise direction in response to control signal 66, support 30 is tilted to left, as shown in FIG. 9B, or to the right, as shown in FIG. 9C, relative to vertical axis 68 of the train car. The direction of rotation of the slotted spur gear, in turn, ultimately depends on the commanded rotation direction of the output shaft of motor 38 in response to control signal 66. The disk or spur gear is configured to be in mesh with drive rack 76, which then drives the remainder of the gearing as described above.

An added advantage provided by gear set 40, and gears 78 and 80 in particular, is the stabilization of train car body 32 when train 16 is traveling slower than the predetermined threshold speed required to cause train car body 32 to tilt. The gears are arranged in such a manner that the turning or pivoting of truck 28 does not result in noticeable tilting of support 30 or train car body 32, increasing the level of realism. To provide a noticeable degree of tilting, substantial rotational input from motor 38 should be required.

Figure 7:
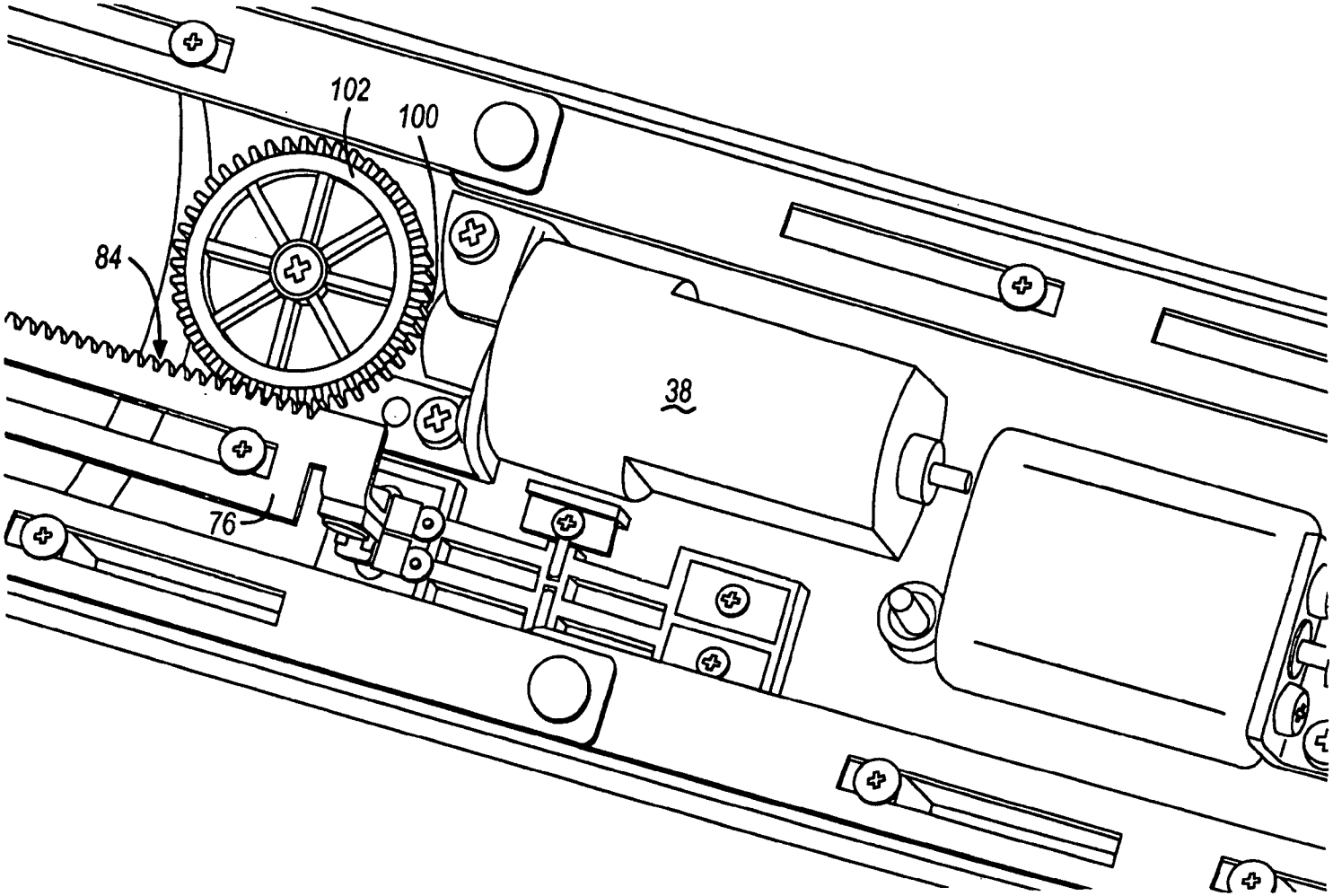
FIG. 7 is a perspective view showing a portion of an exemplary tilt mechanism in accordance with the present invention.

One of ordinary skill may devise alternative gear trains or other motion transformation systems such as belt or chain drives to transform motion from motor 38 to pivoting of support 30. For example, in an alternative embodiment, first worm gear 70 of gear set 40 may be replaced by a pinion gear 100 that is associated with the output shaft of motor 38, as shown in FIG. 7. First and second spur gears 72, 74 may be replaced by a disk gear 102. Disk gear 102 is in mesh with teeth disposed at a first end 84 of rack gear 76, and is configured to drive rack gear 76 in a first and second direction, depending on the direction of rotation of the output shaft, along a horizontal plane 86 defined by rack gear 76. The remainder of this alternative gear train may be as previously described. It should be apparent that a great many other gear trains, combination gear/gearless drive trains, or entirely gearless drive trains may also be suitable for motion transformation as described herein. In addition, either one or both of supports 30, 106 may be tilted using a suitable drive train for tilting of train car 32.

Figure 10:
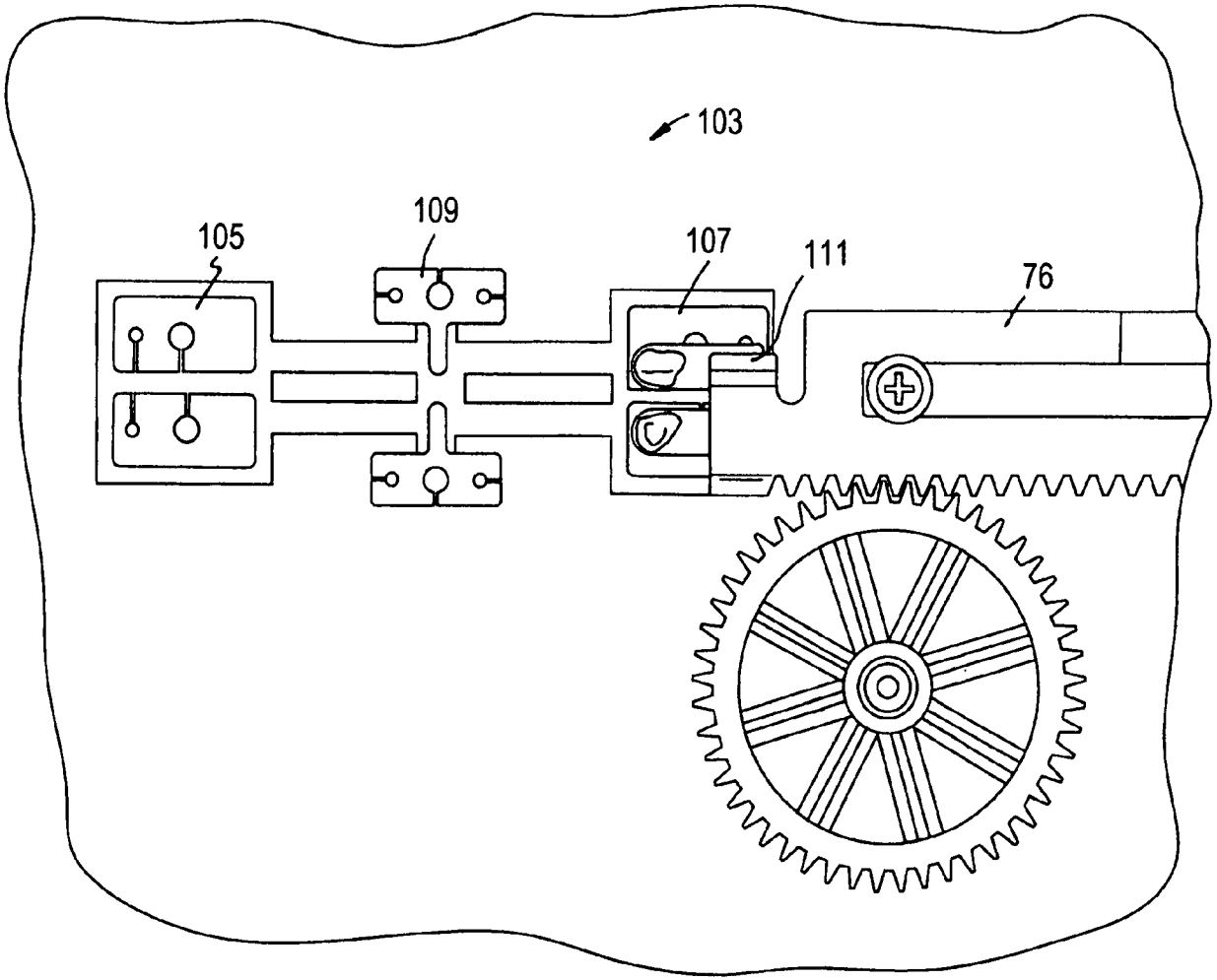
FIG. 10 is a plan view of an exemplary tilt limit sensor in accordance with the present invention.

FIG. 10 shows an exemplary tilt sensor 103. Tilt sensor 103 may be configured to sense the tilt limits in both the left and right direction (e.g., six degrees in each direction, for example), as well as to sense the upright position of train car body 32. Tilt sensor 103 may comprise a plurality of electrical contact pairs, for example, three sets of electrical contacts 105, 107, 109 mounted onto train car body 32. Each pair of contacts may be electrically connected to controller 36. A moveable U-shaped contact 111 may be mounted on rack 76 of either gear train described above. Electrical contact pair 105 may be located so as to contact U-shaped contact 111 at a position corresponding to a tilt limit, for example, a left tilt limit. The members of contact pair 105 may be spaced a distance apart, such that as train car body 32 tilts to the left, rack 76 moves towards contacts 105 until U-shaped contact 111 bridges the contact pair. When the members of the contact pair are thus connected, controller 36 interprets the state of the paired contacts as indicating that train car body has reached maximum tilt to the left, and causes motor 38 to stop rotating.

Similarly, tilt sensor 103 may comprise a second electrical contact pair 107 for signaling an opposite tilt limit. As train car body 32 tilts to the right, rack 76 moves towards contacts 107 until U-shaped contact 111 bridges the contact pair. When the members of the contact pair 107 are thus connected, controller 36 interprets the state of the paired contacts as indicating that train car body has reached maximum tilt to the right, and causes motor 38 to stop rotating.

Sensor 103 may likewise comprise an electrical contact pair 109 for signaling an upright or center position of train car body 32. When the train car 26 is being tilted back towards the center position, the contact pair may be used to signal the motor to stop. For example, when the train car is coming out of either a left or a right turn, motor 38 may be reversed so as to tilt train car body 32 back to an upright position. Rack 76 moves towards contacts 109 until U-shaped contact 111 bridges the contact pair. Controller 36 may interpret the state of the paired contacts 109 as indicating that train car body is upright, and cause motor 38 to stop rotating.

Operation of a tilting mechanism and control system may therefore be summarized as follows. As a train comprising a plurality of train cars enters a curved portion of track, a coupling member for each car traversing the curve is pulled in the direction of the curve. As the coupling member reaches a predetermined rotational position, an electrical contact disposed on the coupling member makes contact with an electrical contact disposed on the train car. This contact indicates the turn direction to a controller. If the sensed speed of the train is above a predetermined threshold, the controller then generates a control signal for driving a tilt mechanism motor in the direction of the turn. The motor turns an output shaft in the direction indicated by the control signal. The rotation of the output shaft then drives a gear set that is coupled to a support, and causes the support to tilt into the turning direction of the train. The motor continues to rotate until a predetermined limit of tilt is reached, as indicated by a feedback signal received by the controller. When the train comes out of the turn and starts to straighten out, the coupling member moves to the center, away from the electrical contact. In response, the controller reverses the motor direction, causing the train car to turn upright until the tilt limit sensor sends a signal to the controller indicating that the upright position of the train car body has been reached, at which time the operation of the motor is ceased.

Having thus described a preferred embodiment of a model vehicle with an electronically-controlled tilt mechanism, it should be apparent to those skilled in the art that certain advantages of the within system have been achieved. It should also be appreciated that various modifications, adaptations, and alternative embodiments thereof may be made within the scope and spirit of the present invention. For example, a particular tilt mechanism has been illustrated, but it should be apparent that the inventive concepts described above would be equally applicable to other mechanisms arranged according to the spirit and scope of the invention. The invention is defined by the following claims.

What is claimed is:

1. A model vehicle, comprising:

a reduced-scale model vehicle, comprising a car body supported on a wheel assembly by a pivoting support;

a motor having an output shaft, the motor mounted to the model vehicle, and a control circuit operatively coupled to the motor to selectively command rotation of the output shaft; and a tilt mechanism connected to the output shaft of the motor and operably associated with the pivoting support, so as to rotate the pivoting support and car body in a first direction when the output shaft is rotated clockwise, and to rotate the pivoting support and car body in a second direction opposite the first direction, when the output shaft is rotated counter-clockwise;

wherein, direction of pivot of the model vehicle is controlled by commanded rotation direction of the motor output shaft.

2. The model vehicle of claim 1, wherein the control circuit is operably associated with the motor and the tilt mechanism so as to control operation thereof in response to a control input.

3. The model vehicle of claim 2, wherein the control circuit further comprises a programmable controller operably associated with program instructions that define control outputs correlating to the control input.

4. The model vehicle of claim 2, further comprising a position sensor operatively connected to the control circuit for providing at least a portion of the control input, wherein the position sensor is adapted to sense a direction of motion of the model vehicle.

5. The model vehicle of claim 4, wherein the position sensor comprises cooperating electrical contacts positioned to detect a position of a coupling member operatively associated with the wheel assembly, wherein the coupling member is configured for coupling adjacent cars of the model vehicle.

6. The model vehicle of claim 2, further comprising a velocity sensor operatively connected to the control circuit for providing at least a portion of the control input.

7. The model vehicle of claim 4, further comprising a velocity sensor operatively connected to the control circuit for providing at least a portion of the control input, wherein the control circuit is adapted to control the motor in response to input from the velocity sensor and from the position sensor, so as to activate the motor when the position sensor indicates the model vehicle is turning and the velocity sensor indicates that the model vehicle has a velocity greater than a defined threshold velocity.

8. The model vehicle of claim 2, further comprising a tilt sensor operatively connected to the control circuit for providing at least a portion of the control input.

9. The model vehicle of claim 8, wherein the tilt sensor is adapted to sense when the tilt mechanism reaches a defined tilt position.

10. The model vehicle of claim 9, wherein the tilt sensor is adapted to sense when the tilt mechanism reaches a defined center position.

11. The model vehicle of claim 7, further comprising a tilt sensor operatively connected to the control circuit for providing at least a portion of the control input, wherein the control circuit is adapted to control the motor in response to feedback from the tilt sensor.

12. The model vehicle of claim 2, further comprising a user input device operatively connected to the control circuit for providing at least a portion of the control input comprising user input.

13. The model vehicle of claim 12, wherein the control circuit is further adapted to receive the user input transmitted from a remote input device.

14. The model vehicle of claim 1, wherein the tilt mechanism comprises a motion transformation mechanism transforming rotational input from the motor to a pivoting motion of the pivoting support.

15. The model vehicle of claim 12, wherein the motion transformation mechanism comprises a gear set disposed between the motor and the pivoting support.

16. The model vehicle of claim 13, wherein the gear set comprises a pin connected to the pivoting support and disposed in a slotted spur gear.

17. The model vehicle of claim 1, wherein the pivoting support is connected to the wheel assembly via a four-point pivot.

18. A model vehicle, comprising:

a reduced-scale model vehicle, comprising a car body supported on a wheel assembly by a pivoting support;

a motor having an output shaft, the motor mounted to the model vehicle, and control means operatively coupled to the motor to selectively command rotation of the output shaft; and tilt means for rotating the pivoting support and car body in a first direction when the output shaft is rotated clockwise, and for rotating the pivoting support and car body in a second direction opposite the first direction, when the output shaft is rotated counter-clockwise, wherein the tilt means are mounted to the model vehicle and operably associated with the pivoting support, and direction of pivot of the model vehicle is controlled by commanded rotation direction of the motor output shaft.

19. The model vehicle of claim 18, wherein the control means is responsive to a control input.

20. The model vehicle of claim 19, further comprising position sensing means for sensing a direction of motion of the model vehicle and providing at least a portion of the control input, the position sensing means operatively associated with the control means.

21. The model vehicle of claim 20, further comprising velocity sensing means for sensing a velocity of the model vehicle and providing at least a portion of the control input, the velocity sensing means operatively connected to the control means.

22. The model vehicle of claim 20, further comprising tilt sensing means for sensing an amount of tilt of the car body and providing at least a portion of the control input, the tilt sensing means operatively connected to the control circuit.

23. The model vehicle of claim 20, further comprising user input means for providing at least a portion of the control input comprising user input commands, the user input means operatively connected to the control circuit.

24. The model vehicle of claim 18, further comprising motion transformation means for transforming rotational input from the motor to a pivoting motion of the pivoting support, the motion transformation means disposed between the motor and the pivoting support.

* * * * *